United States Patent [19]

Waddell

[11] 4,202,418

[45] May 13, 1980

[54] ROLLER CUTTER MOUNTS

[75] Inventor: Bruce A. Waddell, Seattle, Wash.

[73] Assignee: The Robbins Company, Seattle, Wash.

[21] Appl. No.: 901,561

[22] Filed: May 1, 1978

[51] Int. Cl.[2] ..... E21B 9/12

[52] U.S. Cl. ..... 175/361; 175/363; 175/364; 175/373; 308/15

[58] Field of Search ..... 175/361, 363, 364, 373; 299/86; 308/8.2, 15, 27; 407/7

[56] References Cited

U.S. PATENT DOCUMENTS

| | | | |
|---|---|---|---|
| 916,242 | 3/1909 | Winborne | 308/15 |
| 3,191,699 | 6/1965 | Robbins et al. | 175/374 |
| 3,444,939 | 5/1969 | Bechem | 175/334 |
| 3,601,207 | 8/1971 | Coski | 175/364 X |
| 3,612,196 | 10/1971 | Dixon | 175/364 |
| 3,756,332 | 9/1973 | Crane | 175/364 |
| 3,787,101 | 1/1974 | Sugden | 175/364 X |
| 3,835,944 | 9/1974 | Bingham | 175/364 |

*Primary Examiner*—James A. Leppink
*Assistant Examiner*—Nick A. Nichols, Jr.
*Attorney, Agent, or Firm*—Graybeal & Uhlir

[57] ABSTRACT

Roller cutters are mounted onto a cutterhead from the rear side of the cutterhead. A load transfer block is insertable between a stator portion of each cutter and a generally forwardly directed load-carrying surface on the cutter-head frame. Loads imposed on the roller cutter during boring are transmitted rearwardly from the stator to the load transfer block, and from the load transfer block to the cutterhead frame.

7 Claims, 12 Drawing Figures

Fig. 4.
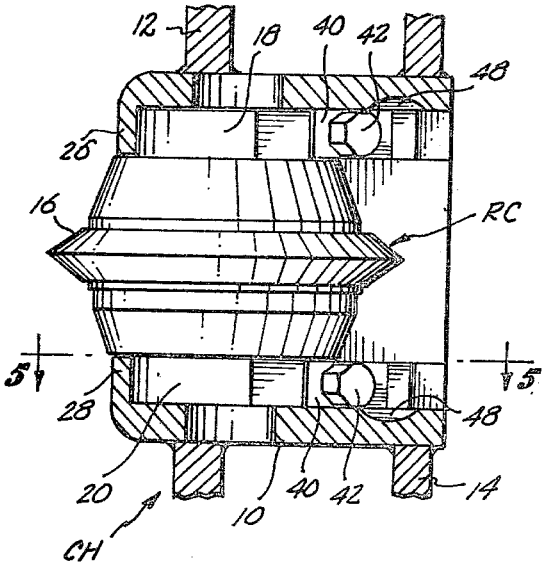
Fig. 5.
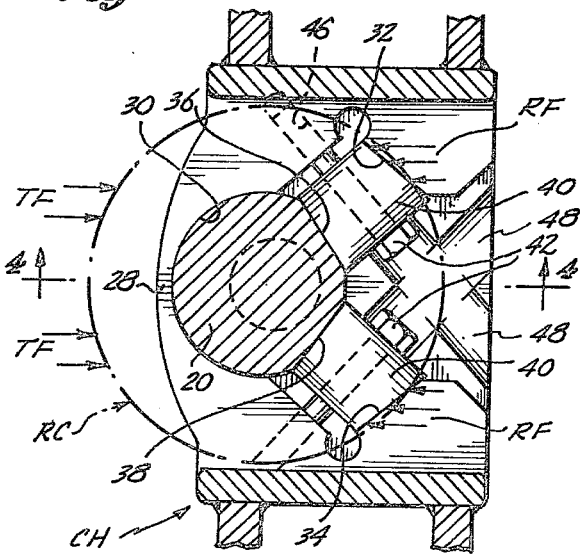
Fig. 6.
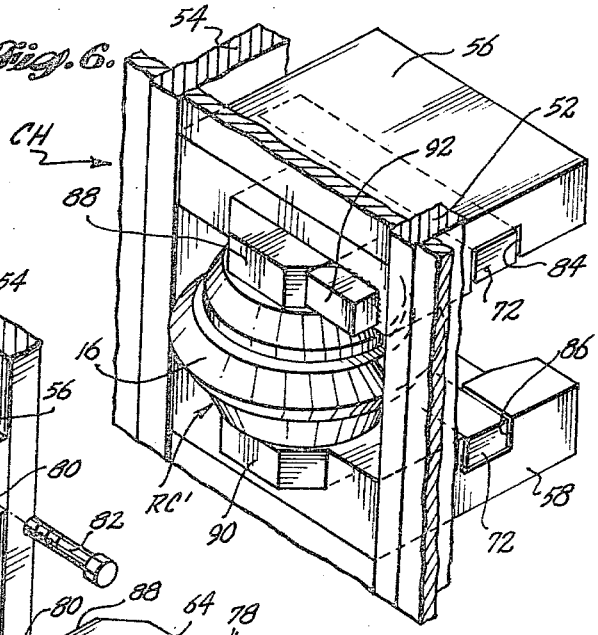
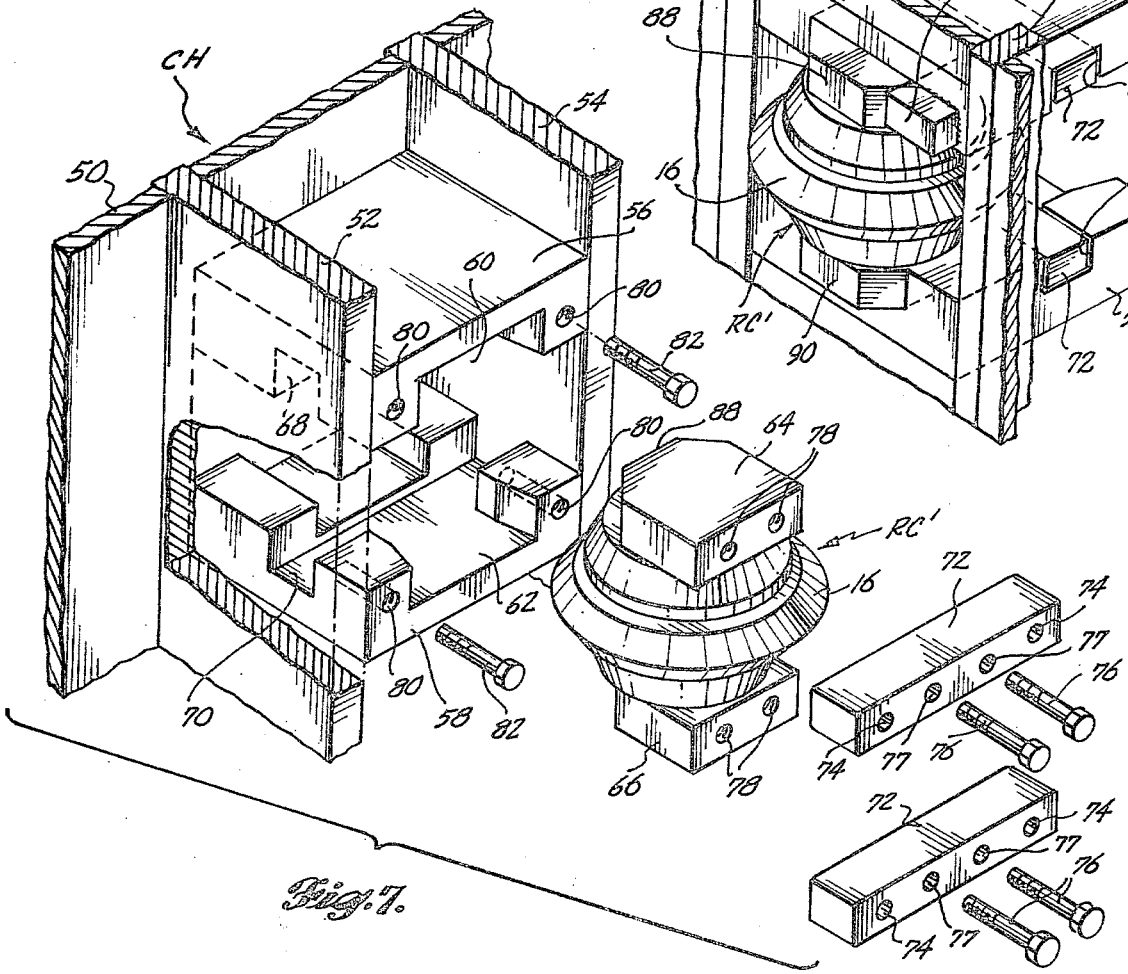
Fig. 7.

ROLLER CUTTER MOUNTS

BACKGROUND OF THE INVENTION

1. Field of the Invention

This invention relates to apparatus for mounting roller cutters onto a cutterhead from the rear of the cutterhead, and in particular to cutter mounting apparatus which carries the thrust loads imposed on the roller cutters in shear and/or compression and directly transmits such loads to the cutterhead frame.

2. Description of the Prior Art

U.S. Pat. No. 3,237,990, granted Mar. 1, 1966 to Richard J. Robbins and Douglas F. Winberg, and U.S. Pat. No. 3,191,699, granted June 29, 1965, also to Richard J. Robbins and Douglas F. Winberg, both present a good description of how a disc type roller cutter works. U.S. Pat. No. 3,237,990 discloses a typical pattern of disc cutters on a large diameter cutterhead. U.S. Pat. No. 3,191,699 discloses a particular mount for a disc cutter.

U.S. Pat. No. 3,612,196, granted Oct. 12, 1971, to Robert L. Dixon, discloses a second common type of roller cutter and another type of cutter mount.

The cutter mounts disclosed by U.S. Pat. Nos. 3,191,699 and 3,612,196 are both front access or front loaded type mounts. That is, the cutters must be replaced from the front side of the cutterhead. In order to replace a cutter the drilling machine must be backed up to provide a space between the tunnel face and the front of the cutterhead. A workman must then enter the space in order to change the cutter.

It is known in the prior art to mount roller type cutters from behind the cutterhead (i.e. back loading) so that the machine need not be backed up and the workmen need not be subject to the dangers inherent to having to work in the space between the cutterhead and the tunnel face. However, the known rear access or back loaded cutter mounts are constructed essentially like the cutter mount disclosed by the aforementioned U.S. Pat. No. 3,191,699, except that the support frame or block is built into the cutterhead and the retaining cap is directed rearwardly. An example of such a rear access cutter mount is disclosed by U.S. Pat. No. 3,444,939, granted May 20, 1969 to Karl G. Bechem. A disadvantage of this type of mount is that the thrust loads which are imposed on the cutters are carried by bolts in tension and their failure rate is relatively high.

SUMMARY OF THE INVENTION

The rear access cutter mounts of the present invention are basically characterized by a load transfer block which is insertable into a load transferring position between a stator portion of the roller cutter and a generally forwardly directed load carrying surface on a frame portion of the cutterhead. The loads imposed on the roller cutter during boring are transmitted from the stator to the load transfer block, putting it into shear and/or compression, and from the load transfer block to the cutterhead frame.

BRIEF DESCRIPTION OF THE DRAWING

FIG. 4 is an axial sectional view taken through the roller cutter assembly;

FIG. 5 is a diametrical section view taken through the roller cutter assembly;

FIG. 6 is a pictorial view looking towards the front of a second form of roller cutter mount;

FIG. 7 is an exploded pictorial view looking towards the rear of the roller cutter assembly of FIG. 6;

DESCRIPTION OF THE PREFERRED EMBODIMENTS

Figure 1:
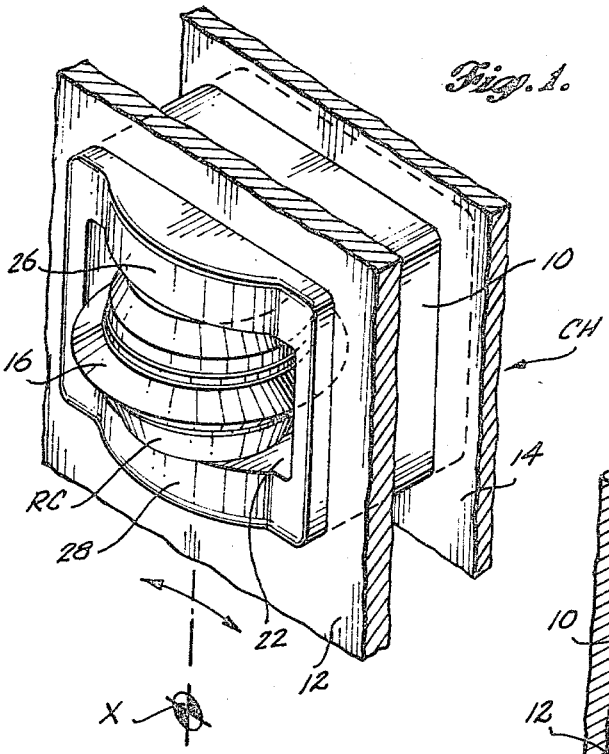
FIG. 1 is a pictorial view of a portion of a cutterhead, taken from above and looking towards the front side of a first form of roller cutter mount constructed in accordance with the present invention.

Referring first to FIGS. 1–5, a box-like frame structure 10 is shown interconnected between front and rear wall portions 12, 14 of a rotary cutterhead CH, to define a roller cutter mounting well or chamber. As is well known in the mechanical machine earth boring art, rotation of the cutterhead CH either clockwise or counterclockwise about its center of rotation X (FIG. 1) will cause the cutting portion 16 of a roller cutter RC to travel a circular path concentric with the cutterhead axis X.

By way of typical and therefore non-limitative example, the roller cutter RC may be of the disc cutter type, designed to both cut a kerf in relatively hard ground material and exert a fracturing force on the ground material on opposite sides of the kerf. Except for the construction of its end portions 18, 20 of its stator, the type of roller cutter RC that is illustrated is essentially identical to the roller cutter that is disclosed by U.S. Pat. No. 3,787,101, granted Jan. 22, 1974, to David B. Sugden. For this reason the details of the roller cutter RC are not herein illustrated or described.

The roller cutter RC may comprise a cutter wheel portion 16 and a supporting stator. Herein, the term "stator" is used to mean the non-rotating portions of the roller cutters RC, including a shaft-like central support structure on which the end members 18, 20 are mounted.

The frame structure 10 defines a well or chamber in which the roller cutter RC is mounted. Such cutter well includes a window 22 at its front end and a portal 24 at its rear end. The roller cutters RC is inserted into and removed from the cutter well from behind the cutterhead CR via the portal 24.

Figure 2:
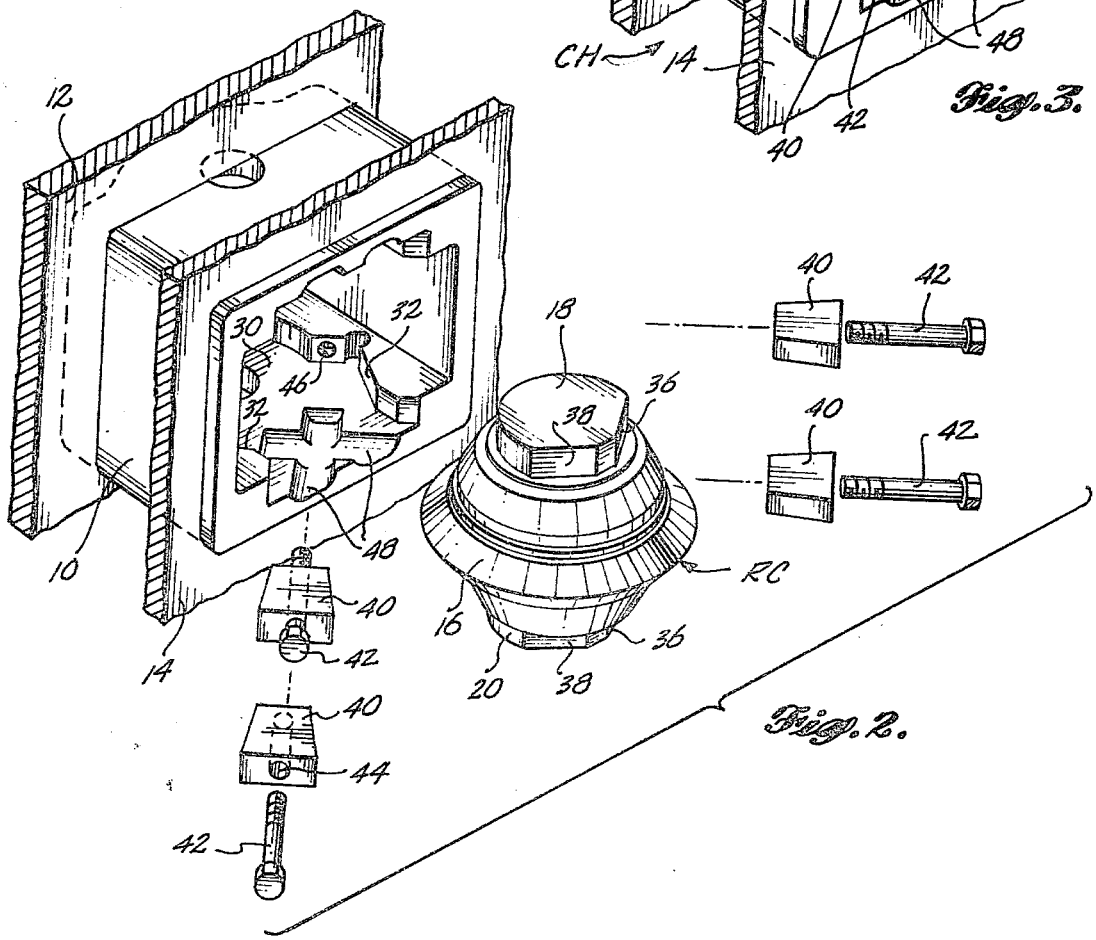
FIG. 2 is an exploded pictorial view looking towards the rear of such roller cutter mount.

As best shown by FIGS. 1, 4 and 5, the radial inner and outer portions of the window 22 are bordered by abutments 26, 28 which form forward stops for the end members 18, 20 of the roller cutter RC. As shown by FIGS. 2 and 5 in particular, the frame 10 is constructed to include saddles (one of which is designated 30 in FIGS. 2 and 5) in which the end portions 18, 20 of the stator are snugly received. A clear passage avenue for the end portions 18, 20 is provided into each one of the saddles. The frame 10 is further formed to include a pair of generally forwardly directed load carrying surfaces 32, 34 at each end of the roller cutter RC. These surfaces are provided on frame structure which is spaced laterally outwardly from such avenues, as best shown by FIG. 5. The surfaces 32, 34 may be set at an angle relative to the general plane of the cutterhead, and may be dihedrally related to each other. The end members 18, 20 are formed to include a pair of complementary surfaces 36, 38 which are dihedrally related to each other. According to the invention, load transfer block 40 is insertable into the space between surfaces 32, 36 and another such block is insertable between surfaces 34, 38. In the embodiment disclosed by FIGS. 1–5, four such blocks 40 are employed, two at each end of the roller cutter RC.

As clearly shown by FIG. 5, the surfaces 32, 36, and the surfaces 34, 38 may converge together as they extend inwardly of the cutter well. The blocks 40 have converging or tapering edges which substantially conform to the angular spacing of surfaces 32, 36 and surfaces 34, 38.

After a roller cutter RC has been installed into the cutter well, by moving it through the portal 24 and forwardly in such well until the end members 18, 20 are against the abutment 26, 28, and the forward peripheral portion of the cutter wheel 16 is projecting out through the window 22, the blocks 40 are set into place. Blocks 40 may be secured in place by means of bolts 42. In the embodiment of FIGS. 1–5 a single bolt 42 is provided for each block 40. Bolt 42 may extend through an opening 44 in the block 40 and thread into an internally threaded opening 46 formed in a portion of the frame 10.

As clearly shown by FIG. 5, thrust forces TF acting on the cutter wheel 16 are transmitted through the blocks 40 directly to those portions of the frame 10 which include load carrying surfaces 32, 34. In FIG. 5 the reaction forces carried through the frame are designated RF. Thus, the thrust forces are not merely carried by bolts in tension, as is the case in known installations wherein the roller cutter RC is mounted from the rear side of the cutterhead CH. Rather, they are transmitted through the blocks 40, which are in shear and compression, directly to positions of the cutterhead frame.

Figure 3:
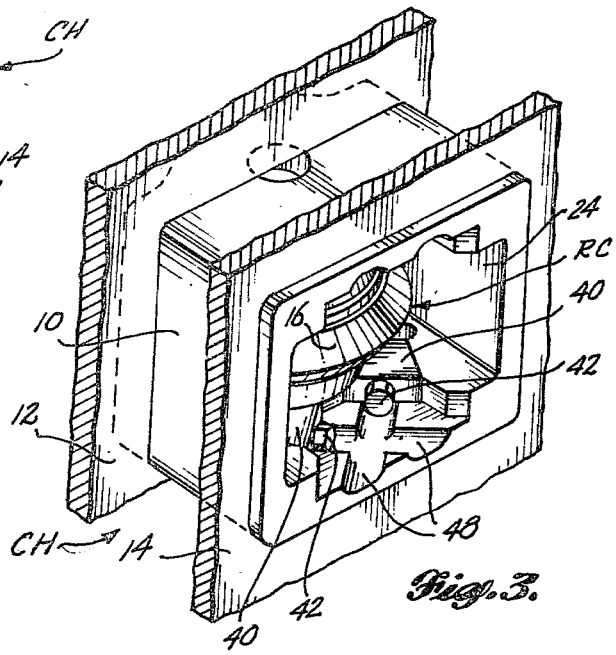
FIG. 3 is a view like FIG. 2, but showing the roller cutter installed.

As shown by FIGS. 2, 3 and 5, the radially inner and outer walls of the frame member 10 may be formed to include crossing channels 48 into which a suitable wrench may be inserted for turning the bolts 42.

The embodiment shown by FIGS. 7, 8 and 9 will now be described:

The cutterhead to which this embodiment relates may include a forward wall 50 secured to a frame which includes a pair of parallel plates 52, 54 which extend radially of the cutterhead but both occupy axial planes. At least some of the cutter compartments or wells are located between plates 52, 54. As shown by FIGS. 7, 8 and 9, a pair of spaced apart end members 56, 58 may be welded into place between the plates 52, 54 to form a cutter compartment or well. The inner side of each end member 56, 58 is machined or otherwise constructed to include an avenue 60, 62 sized to rather snugly receive a squared end portion 64, 66 of the stator part of a roller cutter RC', and also a transverse load block receiving channel 68, 70.

As in the first embodiment, the roller cutter RC' is moved into and is removed out from the cutter well from behind the cutterhead. FIG. 7 shows a roller cutter assembly RC' spaced rearwardly from the rear portal of the cutter well. When it is moved forwardly into the well the end portions 64, 66 of the stator part of roller cutter RC' enter rather snugly into the avenues 60, 62. The roller cutter RC' is moved forwardly into the well as far as it will go, into a position in which the planar rear surfaces of the end members 64, 66 are substantially flush with the forward vertical surfaces of the channel 68, 70. Then, load transferring blocks 72 are moved through the rear portal and into the channels 68, 70 (FIG. 9). A first set of bolts 76 may be inserted through openings 77 formed through the blocks 72 and threaded into openings 78 provided in the end members 64, 68. As will be appreciated, when the bolt 76 are tightened they will firmly connect the end members 64, 66 to the load transverse block 72. A second set of bolts 82 may extend through a second set of openings 74 provided in the blocks 72 and then be threaded into threaded holes 80 provided in the frame members 56, 58. As will be appreciated, when these bolts 82 are tightened they will firmly connect the load transfer block 72 to the frame members 56, 58 (see FIG. 9). Tightening of bolts 82 will draw the load transfer blocks 72 into tight engagement with load carrying surfaces 84 which are the forwardly directed surfaces of channel 68, 70. The surfaces 84 are surfaces on the cutterhead frame since the members 56, 58 are portions of the cutterhead frame. Thus, as in the first embodiment, thrust loads imposed on the cutting portion 16 of roller cutter RC' are transmitted through the load transferring blocks 72 into the cutterhead frame.

Figure 8:
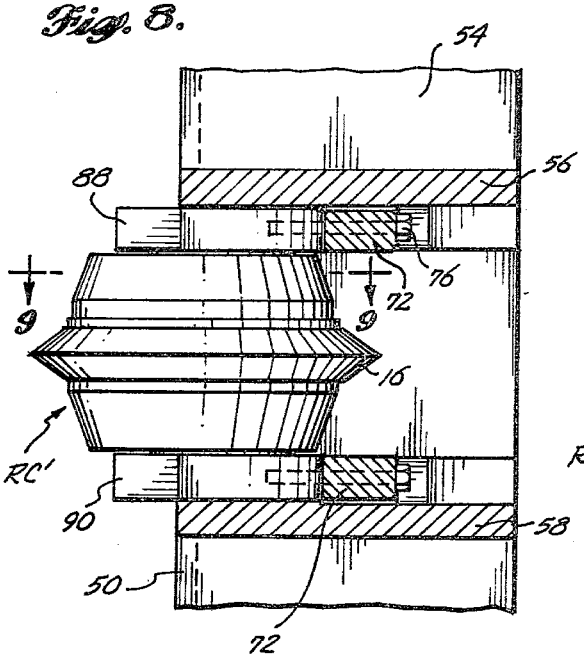
FIG. 8 is an axial sectional view taken through the roller cutter assembly of FIGS. 6 and 7.
Figure 9:
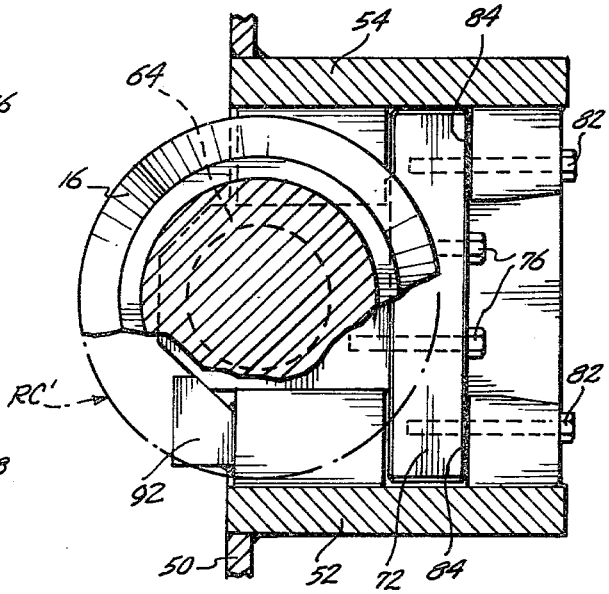
FIG. 9 is a diametrical section view looking through the roller cutter assembly of FIGS. 6–8, taken substantially along line 9—9 of FIG. 8.

As best shown by FIGS. 6 and 8, forward portions 88, 90 of the end members 64, 66 project forwardly of the front surface of cutterhead face 50. The corners of the projecting parts 88, 90 may be chamfered, as shown. Forward movement of the roller cutter RC' all the way through the cutter well (which is unwanted) may be arrested by a stop 92 that is welded onto the cutterhead face 50 and positioned to contact a chamfered corner of one of the end members, e.g. end member 88, as shown by FIG. 9.

Figure 12:
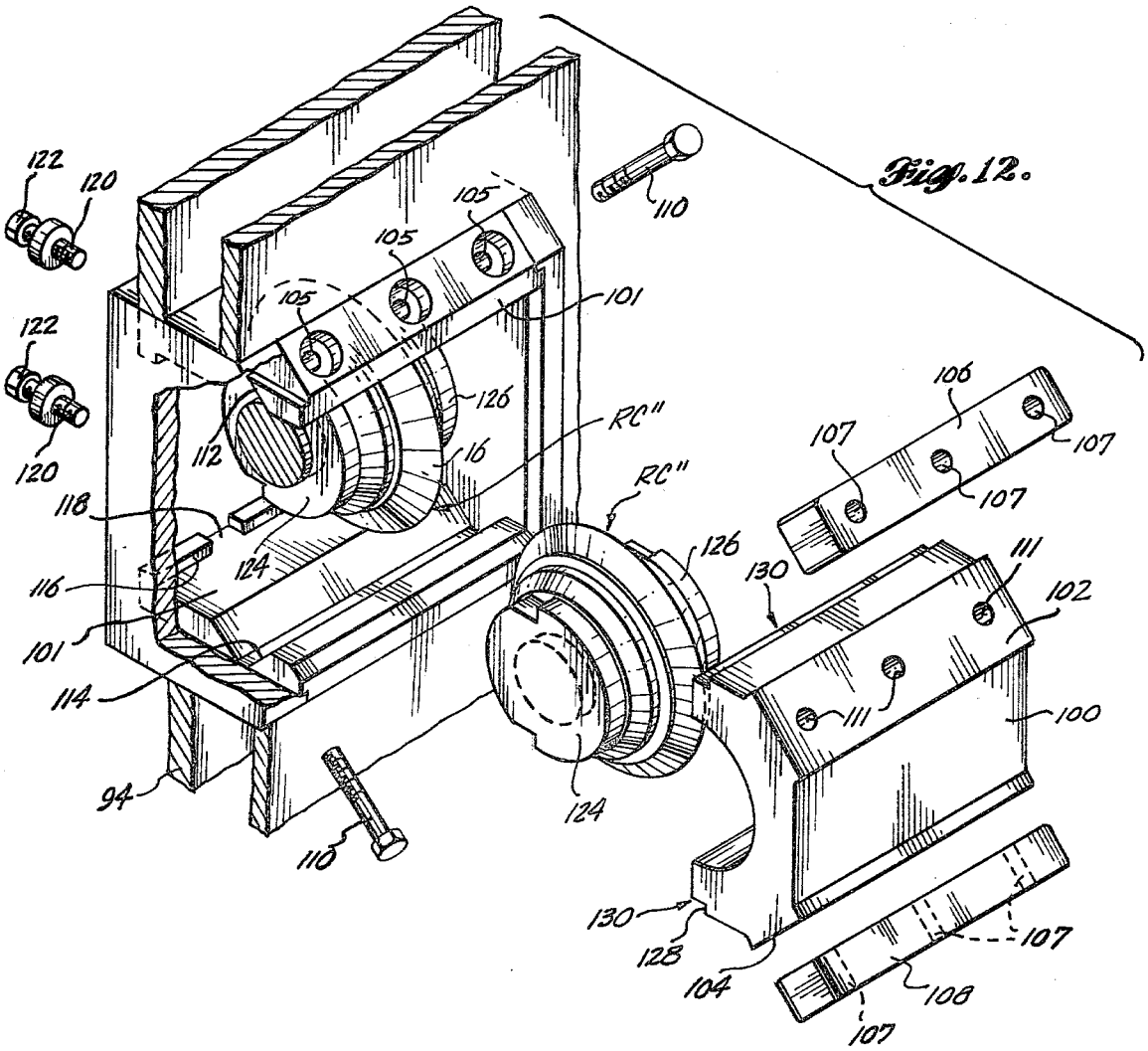
FIG. 12 is an exploded pictorial view taken from behind a portion of the center cutter assembly.
Figure 10:
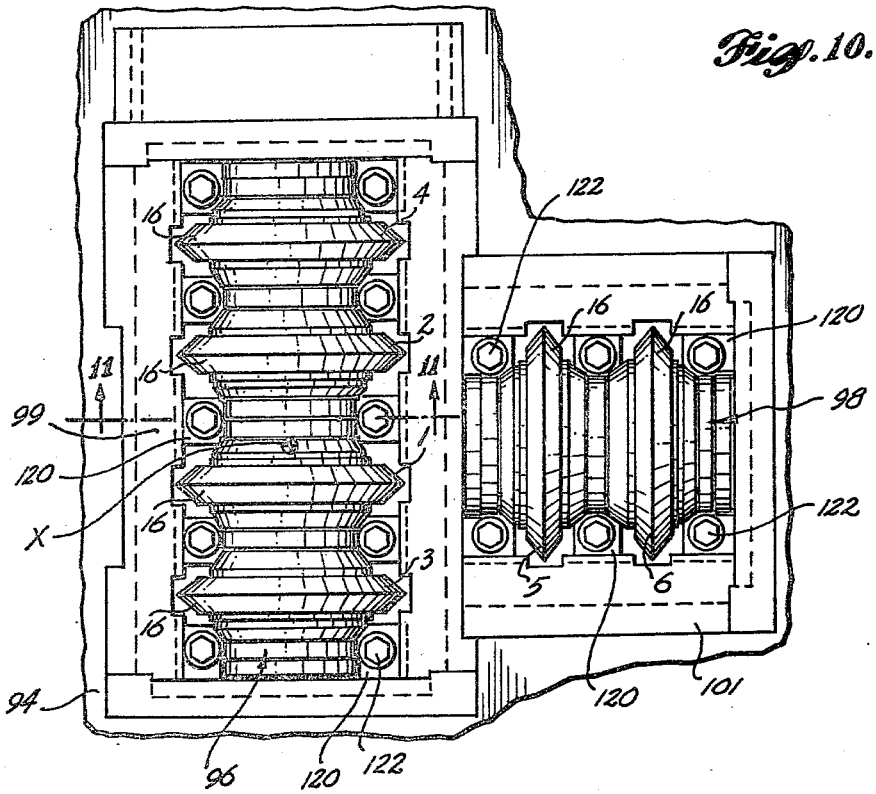
FIG. 10 is a front elevational view of a center portion of a cutterhead, showing a center cutter assembly embodiment of the invention.
Figure 11:
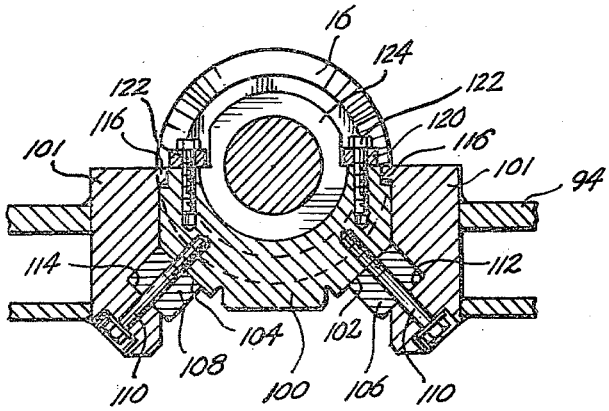
FIG. 11 is a sectional view taken substantially along line 11—11 of FIG. 10.

FIGS. 10, 11 and 12 relate to a center cutter assembly embodying the present invention. A first group 96 of roller cutters RC" are mounted in axial alignment within an elongated cutter well formed at the center region of cutterhead 94. A second group 98 of roller cutters RC" are mounted within a second cutter well which is closely adjacent to the center region of the cutterhead 94. In FIG. 10 the roller cutters RC" of these two groups are numbered 1, 2, 3, 4, 5, 6, in accordance with their relative position to the center of rotation of the cutterhead 94. The frame portions of these two cutter wells are similarly constructed. Therefore, only one will be described, and the cutter well for group 98 has been chosen for that purpose.

As best shown by FIGS. 11 and 12, the cutter well frame includes a pair of opposed frame members 101 which are arranged in mirror image symmetry. A cutter assembly comprising a pair of roller cutters RC" mounted onto a common shaft is secured by bolts 122 and lugs 120 to a carrier frame 100, in similar fashion to the way that the roller cutter assembly disclosed by U.S. Pat. No. 3,756,332, granted Sept. 4, 1973, to Clayton H. Crane, is secured to its mount. The carrier 100, with the roller cutter assembly secured thereto, is inserted through the rear portal of the cutter well and is moved forwardly until the forward surfaces 128 of recesses 130 abut against the rear surfaces of flanges 116 (FIGS. 11 and 12). Openings 118 are machined or otherwise formed through the flanges 116 to provide clearance for the lugs 120. When the mount 100, with the roller cutter assembly attached thereto, is in place against the flanges 116, which function as forward stops (FIG. 11), load transfer blocks 106, 108 are inserted into the spaces defined by and between surfaces 102, 104 on mount 100 and surfaces 112, 114 which are a part of frame members 101. As best shown by FIG. 11, surface 104 may be parallel to surface 114 and surface 102 may be parallel to surface 112. The load transferring members 106, 108 may be elongated rectangular bars sized to snugly fit into the spaces which are between surfaces 102 and 112 on one side of the cutter well and between surfaces 104 and 114 on the other side of the cutter well.

As clearly shown by FIG. 11, when the load transfer blocks 106, 108 are not in place, the mount 100 may be moved into or out from the cutter well. It is sized to snugly fit within the cutter well.

The blocks 106, 108 may be formed to include openings 107. A plurality of bolts 110 may extend through openings 105 in the cutter well frame 101, then through the openings 107, and thread into threaded openings 111 provided in the mount 100. As in the earlier embodiment, the end members 124, 126 of each roller cutter RC″ may be externally configured as illustrated, but internally constructed like the end members which are a part of the cutter disclosed by the aforementioned U.S. Pat. No. 3,787,101. When the blocks 106, 108 are set into place, a rearward force acting on the cutter portions 116 of the roller cutters RC″ is transmitted through the blocks 106, 108 to the frame 101.

What is claimed is:

1. In an earth boring cutterhead having rear mounted roller cutters, the mounting improvement comprising:

frame means defining a cutter well for receiving a roller cutter of a type comprising at least one rotating cutterwheel and a stator, said cutter well having a rearwardly directed portal and a forwardly directed window, wherein a peripheral portion of the cutterwheel projects through said window and extends forwardly of the cutterhead when the roller cutter is secured within said cutter well;

said frame means having integral abutments along the margins of said window for restraining forewardly movement of said roller cutters with respect to said cutter well;

said portal being of a size sufficient to permit passage of a corresponding roller cutter for mounting on and for removal from said cutter well;

said frame means also defining at least one generally forwardly directed load carrying surface; and means for securing said roller cutter within said cutter well, comprising a load transfer block insertable from the rear of said cutter well into a load transferring position between said stator and said load carrying surface once said roller cutter has been placed within said cutter well, so that thrust loads imposed on said roller cutter during boring are transmitted from the stator to the load transfer block and from the load transfer block directly to said frame means, and means for retaining the load transfer block in place.

2. The improvement of claim 1, wherein the means for retaining the load transfer block in place includes a bolt which extends through an opening in the load transfer block and threads into a portion of said frame means.

3. The improvement of claim 1, wherein the means for retaining the load transfer block in place includes a bolt which extends through an opening in a portion of said frame means and threads into said load transfer block.

4. The improvement of claim 1, wherein the means for retaining the load trasfer block in place includes a bolt which extends through openings in the frame means and the load transfer block and threads into said stator.

5. The improvement of claim 1, wherein said stator comprises end portions which project outwardly beyond the side boundaries of the cutter wheels; and wherein said generally forwardly directed load carrying surface is spaced axially of the cutterhead from an end portion of said stator; and wherein after said roller cutter has been placed within said cutter well, said load transfer block is insertable between a surface on said end portion of the stator and said generally forwardly directed load carrying surface on said frame means.

6. The improvement of claim 5, comprising at least one generally forwardly directed load carrying surface for each end portion of the stators, and a separate load transfer block insertable between each such generally forwardly directed load carrying surface and a surface on the related end portion of the stator.

7. The improvement of claim 5, wherein said frame means includes a pair of generally forwardly directed load carrying surfaces at each end of the roller cutter assembly, one of said pairs of load carrying surfaces leads and the other of said pairs of load carrying surfaces trails the roller cutter during cutterhead rotation, and a separate load transfer block insertable between each such generally forwardly directed load carrying surface and a related surface on the end portion of the stator.

* * * * *